US005798329A

United States Patent [19]

Taylor et al.

[11] Patent Number: 5,798,329

[45] Date of Patent: Aug. 25, 1998

[54] GERMICIDAL LIQUID LAUNDRY DETERGENT COMPOSITIONS

[75] Inventors: Timothy J. Taylor, Edison; Alan F. Richter, Branchburg, both of N.J.

[73] Assignee: Reckitt & Colman Inc., Montvale, N.J.

[21] Appl. No.: 666,897

[22] Filed: Jun. 20, 1996

[30] Foreign Application Priority Data

Jan. 31, 1996 [GB] United Kingdom ..... 9601904

[51] Int. Cl.[6] ..... C11D 1/06; C11D 1/12; C11D 1/62; C11D 1/86

[52] U.S. Cl. ..... 510/384; 510/276; 510/286; 510/289; 510/290; 510/299; 510/308; 510/327; 510/329; 510/333; 510/340; 510/341; 510/350; 510/351; 510/352; 510/356; 510/536

[58] Field of Search ..... 510/276, 289, 510/290, 299, 308, 327, 329, 333, 340, 341, 350, 351, 352, 356, 536, 286, 384

[56] References Cited

U.S. PATENT DOCUMENTS

| | | | |
|---|---|---|---|
| 4,264,457 | 4/1981 | Beeks et al. | 252/8.75 |
| 4,272,395 | 6/1981 | Wright | 252/106 |
| 4,576,729 | 3/1986 | Paszek et al. | 252/106 |
| 4,810,409 | 3/1989 | Harrison et al. | 252/102 |

FOREIGN PATENT DOCUMENTS

| | | |
|---|---|---|
| 0 133 900 A2 | 3/1985 | European Pat. Off. . |
| 0133900 A2 | 3/1985 | European Pat. Off. . |

OTHER PUBLICATIONS

Copy of PCT Search Report for International Application No. PCT/US96/19735 dated 4 Jun. 1997.

*Primary Examiner*—Paul Lieberman
*Assistant Examiner*—Charles Boyer
*Attorney, Agent, or Firm*—Fish & Richardson P.C.

[57] ABSTRACT

Liquid laundry detergent compositions provide good detergency for the cleaning of garments and textiles, as well as further providing a germicidal action to textile fabrics in a domestic laundering process. The liquid detergent compositions are aqueous compositions which comprise:

A) 1–40 parts by weight of one or more anionic surfactant compositions selected from alkylethercarboxylates and alkylethersulfonates;

B) 1–25 parts by weight of one or more quaternary ammonium surfactant compositions having germicidal properties;

C) 3–50 parts by weight of one or more nonionic surfactant compositions selected from linear and secondary alcohol alkoxylates, alkylphenol ethoxylates, alkyl polyglycosides, amine oxides, alkanolamides;

D) 0–10 parts by weight of one or more anionic co-surfactant compositions selected from alkylsulfates, alkylsulfonates, alkylethersulfates, alkylarylsulfonates, alkylarylethersulfates present in a proportion not exceeding one half of the weight of the one or more quaternary ammonium surfactant compositions having germicidal properties;

wherein the weight ratios of B:A are at 1:2 or greater, with the remaining balance to 100 parts by weight of water. Further conventional additives may be included as optional constituents. The liquid laundry detergent compositions are effective in wash bath dilutions of 1:500 and lower dilutions.

20 Claims, No Drawings

GERMICIDAL LIQUID LAUNDRY DETERGENT COMPOSITIONS

Liquid detergent compositions, particularly concentrated liquid detergent compositions which find particular use in laundering textiles and garments are well known to the art. Salient characteristics of such compositions include: good detergency, good anti-soil redeposition properties, minimal deleterious effect to textiles or garments washed with the same, such as color fading or decomposition of the textile or garments due to the action of one or more constituents in the detergent compositions, i.e., undesirable enzymatic effects. Liquid detergent compositions of this type, which are well known to both commercial and private consumers, include detergent compositions which are marketed for use in the laundering of garments or textiles in a washing machine. While such compositions are well known to provide good cleaning effects, it is also known that such liquid detergent compositions, presently being marketed as a laundry detergent compositions, do not generally provide a particularly effective sanitizing or disinfecting effect to the laundered garments or textiles. Such laundry detergent compositions typically fail to provide for specific protection against harmful bacteria and other microorganisms present in the garments or textiles. Accordingly, there exists a present need in the art of laundry detergent compositions for products which provide both excellent detergency and a sanitizing effect providing for a high level of protection against harmful bacteria as may normally be present in the household including gram positive and gram negative vegetative bacteria such as those belonging to the species: Salmonella, Klebsiella and Staphylococcus.

While such compositions would be desirable, these have also been difficult to readily produce as it is well known that certain particularly effective cationic surfactant germicides, including certain quaternary ammonium surfactants, are known to be effective against such gram positive and gram negative vegetative bacteria. It may also be readily seen that such germicides are not frequently found to be useful in detergent formulations. Many successful formulations comprise a significant fraction of one or more anionic surfactants, which are well known to be useful detersive agents, which however are considered incompatible with cationic surfactants, particularly quaternary ammonium surfactants. Notwithstanding such a technical problem, certain formulations comprising cationic surfactant germicides are known.

For example, U.S. Pat. No. 5,080,830 teaches a water dispersible composition comprising a hydrophobic quaternary ammonium compound, a polyether derivative compound used as a dispersing agent and certain quaternary ammoniums salts which are used as a stabilizing agent for the aqueous formulations formed from these constituents.

U.S. Pat. No. 5,368,756 to Vogel et al. provides a rinse added fabric softening composition which comprises a mixture of certain diester quaternary ammonium compounds with a highly ethoxylated hydrophobic material and a liquid carrier, preferably water. The invention appears to be directed to limiting the formation of soap scum caused by the interaction of the diester quaternary ammonium compound with anionic detergent surfactants and/or detergency builders which may be entrapped in a fabric being treated.

U.S. Pat. No. 5,399,280 to Woo et al. provides certain hard surface detergent compositions comprising either a mixture of zwitterionic detergent surfactants or a low sudsing nonionic detergent surfactant with a suds reducing amount of a phosphorous containing alkoxylate which compound provides good suds regulation and maintains good spotting/filming and rinsing characteristics, and optionally, but preferably, a hydrophobic solvent which itself provides additional cleaning activity.

U.S. Pat. No. 5,409,621 to Ellis et al. teaches a fabric softening composition comprising a water insoluble quaternary ammonium compound and a nonionic stabilizing agent which may be an alkoxylated $C_8$–$C_{22}$ linear alcohol comprising on average 10 or more moles of an alkylene oxide or which may be a $C_{10}$–$C_{20}$ alcohol, or mixture thereof. These constituents are desirably provided in an aqueous carrier.

U.S. Pat. No. 5,415,813 to Misselyn et al. provides an all-purpose liquid cleaner in the form of a microemulsion which finds use in cleaning hard surfaces are said to be effective in removing grease soils. All of these compositions provide a certain class of quaternary ammonium compounds; such compounds are cited as grease release agents.

U.S. Pat. No. 4,576,729 to Paszek et al. provides stable liquid disinfectant laundry detergent compositions which comprise a nonionic surfactant, a so-called cryptoanionic surfactant and a quaternary ammonium compound which is effective as a germicidal active agent, as well as minor amounts of other nonessential ingredients. Therein is taught that a critical combination of a nonionic surfactant of an ethoxylated octyl or nonyl phenol with a cryptoanionic surfactant of the alkyl alkoxy carboxylate class and a quaternary ammonium germicide in a water carrier in particular ratios of nonionic surfactant:cryptoanionic surfactant:quaternary ammonium germicide, in the range of from 2:4:1 to 3.5:5:1 provide effective laundry detergent compositions which offer a germicidal effect and antisoil redeposition properties. The compositions are provided preferably in liquid form and may comprise other nonessential ingredients including foam stabilizers, anti-irritating agents, brighteners, fragrances, dyes, pH adjusters such as a buffer, or tri-ethanol amine and a viscosity modifier such as ethanol. Therein, it was observed that the addition of the nonionic ethoxylated octyl and nonyl phenol surfactants were an essential constituent in order to provide both stability and good detersive action. Further, as is illustrated on Table 2 of that patent, the compositions taught therein were effective to have germicidal efficacy in aqueous dilutions within the range of from 1:200 to 1:333 in parts by weight, with most of the compositions having germicidal efficacy at maximum dilutions of 1:200–250.

U.S. Pat. No. 4,810,409 to Harrison et al. teaches compositions comprising a quaternary ammonium germicide, anionic and nonionic surfactants wherein the ratio of cationic:anionic surfactant are at least 3.3:1. In such a manner, Harrison demonstrates that such an excess of cationic surfactant is needed to maintain germicidal efficacy in the presence of the claimed amount of anionic surfactant.

U.S. Pat. No. 4,493,773 to Cook et al. teaches certain low phosphate detergent compositions which include nonionic detergent surfactants, an alkyl polysaccharide detergent surfactant, and a cationic softening/anti-static compound which may be a quaternary ammonium cationic surfactant. In the aforesaid compositions, the nonionic surfactant is preferably one according to the formula $R(OC_2H_4)_nOH$ wherein R is a primary alkyl $C_{10-18}$ and n has an average value of from about 2 to 9. The alkyl polysaccharide detergent surfactant is one according to the formula $RO(R'O)_y(Z)_x$ wherein R is an alkyl hydroxalkyl alkylphenol, hydroxyalkyl phenol, alkyl benzyl or mixture of one or more of the above, wherein the alkyl groups comprise from 8 to 18 carbon atoms; where R' contains from about 2 to 4 carbon atoms, y is a value from 0 to about 12, each Z is a moiety derived from reducing saccharide containing 5 or 6 carbon atoms, and x is a number from about 1 to about 10. The quaternary ammonium cationic surfactant has two chains which contain an average from about 16 to about 22 carbon atoms.

U.S. Pat. No. 4,272,395 to Wright teaches a hard surface cleaning composition which comprises a quaternary ammonium compound as a germicidal active agent and a co-surfactant selected from the group consisting of: short chain anionic surfactants having $C_3$–$C_8$ in the hydrophobic group; low alkoxylated nonionic surfactants having 0–4 ethylene oxide and/or propylene groups in the molecule, as well as mixtures thereof. Therein it is taught that compositions comprising a conventional anionic surfactant of more than 8 carbons in the hydrophobic group or conventional nonionic detergents having more than 4 ethylene oxide groups were found to be poor performers as compared with the short chain anionic surfactants of 3 to 8 carbon atoms and/or low alkoxylated nonionic surfactants having 0 to 4 ethylene oxide or propylene groups in the molecule. The compositions of the invention according to U.S. Pat. No. 4,272,395 preferably comprise 50–95 parts by weight of the quaternary ammonium, 5–50 parts by weight of the anionic surfactant and 0–20 parts by weight of the nonionic surfactant.

U.S. Pat. No. 5,378,409 to Ofosu-Asante et al. teaches a specific light duty liquid or gel dishwashing detergent composition which comprises a surfactant mixture (I) which includes: (a) 100% by weight of certain alkyl ethoxy carboxylates according to the formula $RO(CH_2CH_2O)_x CH_2COO^-M^+$; (b) 0 to 10% by weight of alcohol ethoxylate according to the formula $RO(CH_2CH_2O)_xH$ and (c) 0 to 10% of one or more soaps according to the formula $RCOO^-M^+$, (II) from 0.1%–4% calcium ions, and (c) from 0 to about 10% of a calcium chelating agent said to prevent the formation of calcium carbonate participates in the composition, such that the said dishwashing detergent composition in a 10% by weight aqueous solution exhibits a pH of from 7–11. The specification recites that the alkyl ethoxy carboxylate within the surfactant mixture does not comprise a calcium ion, and this Patent later teaches the selected addition of certain salts in order to introduce the calcium ions in specific weight percentages to the cleaning composition. The presence of the calcium ions are cited at providing good grease removal, storage stability, and skin mildness. The specification also recites the use of limited amounts of certain cationic quaternary ammonium compounds as a suds boosting agent. However, among the recited objects of the patent is to provide detergent compositions featuring good grease removal while simultaneously being mild to the skin, technical features which do not generally arise in laundry detergent compositions. Further, there is no mention in the specification of the use of such compositions in a laundry application, particularly a machine washing laundering application.

U.S. Pat. No. 5,230,823 to Wise et al. teaches certain light duty or gel dishwashing detergent compositions which comprise from 5 to 70% by weight of a surfactant mixture comprising: (a) 80 to 100% of an alkyl ethoxy carboxylate of the formula: $RO(CH_2CH_2O)_xCH_2COO^-M^+$ wherein $M^+$ is a cation; (b) 0–10% of alcohol ethoxylates according to the formula: $RO(CH_2CH_2O)_xH$; (c) 0–10% of a soap based upon the formula: $RCOO^-M^+$, wherein a 10% by weight aqueous solution of the cleaning composition exhibits a pH of from 7–11. As opposed to U.S. Pat. No. 5,378,409 discuss supra, compositions according to U.S. Pat. No. 5,230,823 teaches the utility of ions, including magnesium and calcium ions of which magnesium ions are particularly preferred. Also taught as an optional constituent in the compositions according to Wise et al., are certain cationic quaternary ammonium surfactants which are taught to be as suds boosters, i.e., suds stabilizing surfactants. However, as in U.S. Pat. No. 5,378,409 to Ofosu-Asante et al., the recited objects of the patent include the provision of dishwashing detergent compositions featuring good grease removal while simultaneously being mild to the skin, technical features which do not generally arise in laundry detergent compositions. Further, there is no mention in the specification of the use of such compositions in a laundry application, particularly a machine washing laundering application.

U.S. Pat. No. 4,364,457 to Beeks et al. disclose a cationic liquid laundry detergent and fabric softener comprising 3 to 35% nonionic surfactant, 3 to 30% quaternary ammonium surfactant, and a mixture of anionic surfactants selected from alkyl sulfates, alkyl ethersulfates and alkyl ethercarboxylates in which the ratio total cationic to total anionic surfactants is from 0.8:1 to 10:1. The specification makes no reference to any antibacterial properties of the composition.

U.S. Pat. No. 4,333,862 to Smith et al. disclose a liquid detergent composition comprising from 2–100% of a surfactant system consisting essentially of a water soluble combination of anionic, nonionic and quaternary ammonium surfactants wherein the anionic:cationic ratio is less than 5:1 but at least 1:1 and the nonionic:cationic ratio is from 5:1 to 2:3. The specification makes no mention of any antibacterial properties.

Accordingly there remains a need in the art for improved laundry detergent compositions, particularly those which provide good cleaning efficacy as well as an antibacterial effect so to effectively sanitize treated textiles or garments.

Therefore, it is an object of the invention to provide improved laundry detergent compositions, more particularly to provide improved laundry detergent compositions in a concentrated form, which laundry detergent compositions provide both good detersive and good sanitizing effects.

It is a further object of the invention to provide a process for adding germicidal active agents in effective amounts to certain laundry detergent compositions.

It is still a further object of the invention to provide improved laundry detergent compositions in both concentrated and diluted (aqueous) form wherein said laundry detergent is characterized by good foaming, satisfactory detersive properties, and germicidal activity. Such compositions are particularly useful in the laundering of garments and/or textiles particularly when used in conjunction with commercial or residential washing machine designed for the laundering of garments and/or textiles.

According to the invention there is provided a detergent composition comprising

A) a major anionic surfactant selected from alkylethercarboxylates and alkylether sulfonates;

B) a cationic germicidal surfactant; and

C) a nonionic surfactant preferably selected from alcoholalkoxylates, akylphenol alkoxylates, alkylpolyglycosides, amine oxides and alkanolomides, wherein the value of the cationic surfactant to the major anionic surfactant is 1:2 or greater.

The composition may optionally contain further anionic surfactants, wherein the value of the cationic to optional further anionic surfactants is critically maintained at a weight value of 2:1 and greater.

In accordance with one preferred aspect of the present invention, there is provided an aqueous germicidal liquid laundry detergent composition in concentrated form, which composition comprises water, and the following constituents A) 1–40 parts by weight of one or more anionic surfactants selected from alkylethercarboxylates and alkylethersulfonate;

B) 1–25 parts by weight of one or more quaternary ammonium surfactant having germicidal properties;

C) 3–50 parts by weight of one or more nonionic surfactant selected from linear and secondary alcohol alkoxylates, alkylphenol ethoxylates, alkyl polyglycosides, amine oxides, and alkanolamides;

D) 0–10 parts by weight of one or more further anionic surfactant selected from alkylsulfates, alkylsulfonates, alkylethersulfates, alkylarylsulfonates, alkylarylethersulfates which are present in a proportion not to exceed one half of the weight of the one or more quaternary ammonium surfactants; with the proviso that the weight ratios of B:A be within the weight ratio of 1:2 or greater.

Where the detergent compositions includes a further anionic surfactant D, it is present in amounts where the weight value of B to D is 2:1, or greater.

The compositions of the invention may further comprise optional constituents, many of which are well known to the art, including but are not limited to: detergency builders, chelating agents, pH adjusting agents, pH stabilizing agents (buffers), hydrotropes, optical brighteners, coloring agents, fragrances, fillers, as well as others not particularly elucidated here. These optional constituents may be added in any effective amount, but generally the total amount of such optional constituents does not exceed about 10 parts by weight of the total weight of the detergent compositions being taught herein.

Surfactants which find use in the present inventive compositions include materials which are known to the art and include those described in *McCutcheon's Detergents and Emulsifiers*, Vol. 1, North American Edition, 1991; as well as from Kirk-Othmer, *Encyclopedia of Chemical Technology*, 3rd Ed., Vol. 22, pp. 346–387, the contents of which are herein incorporated by reference. The conventional additives which may be further included as one or more of the optional constituents include materials which are also known to the art, and include materials described in the references noted above, as well as in *McCutcheon's Functional Materials*, Vol. 2, North American Edition, 1991

Constituent (A) Particularly useful anionic surfactants which find use in the detergent compositions according to the present invention include at least one (a) alkylethercarboxylate surfactant, and/or at least one (b) alkylethersulfonate surfactant.

Useful alkylethercarboxylate surfactants include compounds according to the formula:

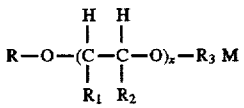

where:

R is a $C_4$–$C_{22}$ linear or branched alkyl group, preferably $C_8$–$C_{15}$ linear or branched alkyl group, and yet more preferably a $C_{12-15}$ linear or branched alkyl group;

x is an integer from 1 to 24, $R_1$, $R_2$ and $R_3$ is a group selected from H, lower alkyl radicals including methyl and ethyl radicals, carboxylate radicals including acetate and propionate radicals, succinate radicals, hydroxysuccinate radicals, or mixtures thereof wherein at least one $R_1$, $R_2$ or $R_3$ is a carboxylate, succinate or hydroxysuccinate radical; and, $M^+$ is a counterion including an alkali metal or ammonium counterion.

Free acid forms of the alkylethercarboxylate compounds noted above may also be used. Preferably, the alkylethercarboxylate compound is one wherein R is $C_{12}$–$C_{15}$, x is an integer from 1–10 inclusive, and $R_1$, $R_2$, and $R_3$ which may be the same or different are preferably selected from H, and carboxylate radicals. Most preferred are alkylethercarboxylate compounds wherein R is $C_{12}$–$C_{15}$, x is an integer from 1–10 inclusive, and $R_1$ and $R_2$ are both hydrogen, and $R_3$ is a $CH_2COO^-$ radical, and $M^+$ is a counterion selected from sodium, potassium and ammonium counterions. Such alkylethercarboxylate compounds are per se known and are available in commercial preparations wherein they are frequently provided with an aqueous carrier. Examples of such presently available commercial preparations include SURFINE WLG (Finetex Inc., Elmwood Park, N.J.), SANDOPAN DTC (Clariant Chem. Co., Charlotte, N.C.) in salt forms, and in free acid forms include those marketed under the tradename NEODOX (Shell Chemical Co., Houston, Tex.).

Alternatively, or in addition to the (a) alkylethercarboxylate surfactants noted above, there may be used one or more (b) alkylethersulfonate surfactants.

Exemplary alkylethersulfonate surfactants which may be used include those according to the formula:

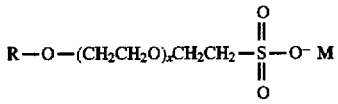

where:

R is a $C_4$–$C_{22}$ linear or branched alkyl group, preferably $C_8$–$C_{15}$ linear or branched alkyl group, and yet more preferably a $C_{12-15}$ linear or branched alkyl group;

x is an integer from 1 to 24, and, $M^+$ is alkali metal or ammonium counterion.

Free acid forms of the alkylethersulfonate compounds noted above may also be used. Preferably, the alkylethersulfonate compound is one wherein R is $C_{12}$–$C_{15}$, x is 1–10 and $M^+$ is a counterion selected from sodium, potassium and ammonium counterions.

Such alkylethersulfonate compounds are known and are available in commercial preparations wherein they are frequently provided with an aqueous carrier. Examples of such commercially available preparations include AVANEL S30 and AVANEL S70 (PPG Industries, Pittsburgh, Pa.)

In the concentrated liquid detergent compositions according to the invention, the anionic surfactant of Constituent (A) comprises from 1–40 parts by weight of the liquid detergent compositions, more preferably comprise from 5–30 parts by weight of the active constituents of the liquid detergent compositions, but most preferably comprise from 10–20 parts by weight of the active constituents of the liquid detergent compositions.

Constituent (B)

Cationic surfactants which exhibit germicidal activity and which may be used in the detergent compositions include certain quaternary ammonium surfactants, of which one or more such cationic surfactants may be used as the present Constituent (B). Exemplary useful quaternary ammonium compounds and salts thereof include quaternary ammonium germicides which may be characterized by the general structural formula:

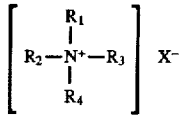

where at least one or $R_1$, $R_2$, $R_3$ and $R_4$ is a hydrophobic, aliphatic, aryl aliphatic or aliphatic aryl radical of from 6 to 26 carbon atoms, and the entire cation portion of the molecule has a molecular weight of preferably at least 165. The hydrophobic radicals may be long-chain alkyl, long-chain alkoxy aryl, long-chain alkyl aryl, halogen-substituted long-chain alkyl aryl, long-chain alkyl phenoxy alkyl, aryl alkyl, etc. The remaining radicals on the nitrogen atoms other than the hydrophobic radicals are substituents of a hydrocarbon structure usually containing a total of no more than 12 carbon atoms. The radicals $R_1$, $R_2$, $R_3$ and $R_4$ may be straight chained or may be branched, but are preferably straight chained, and may include one or more amide or ester linkages. The radical X may be any salt-forming anionic radical.

Exemplary quaternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium salts include those in which the molecule contains either amide or ester linkages such as octyl phenoxy ethoxy ethyl dimethyl benzyl ammonium chloride, N-(laurylcocoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

Preferred quaternary ammonium compounds which act as germicides and which are be found useful in the practice of the present invention include those which have the structural formula:

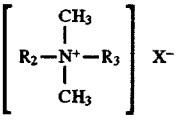

wherein $R_2$ and $R_3$ are the same or different $C_8$–$C_{12}$alkyl, or $R_2$ is $C_{12-6}$alkyl, $C_{8-18}$alkylethoxy, $C_{8-18}$ alkylphenoxyethoxy and $R_3$ is benzyl, and X is a halide, for example chloride, bromide or iodide or is methosulfate. The alkyl groups recited in $R_2$ and $R_3$ may be straight chained or branched, but are preferably substantially linear.

Such quaternary germicides are usually sold as mixtures of two or more different quaternaries, such as BARDAC® 205M, (presently commercially available from Lonza, Inc., Fairlawn, N.J.) which is believed to be a 50% aqueous solution containing 20% by weight of an alkyl dimethyl benzylammonium chloride (50% C14, 40% C16 alkyl); 15% by weight of an octyl decyl dimethylammonium chloride; 7.5% by weight of dioctyl dimethylammonium chloride; and 7.5% by weight of didecyl dimethylammonium chloride. A further useful quaternary germicide is CYNCAL® 80% (presently commercially available from Hilton Davis Chemical Co., Cincinnati, Ohio) which is believed to comprise 80% by weight of an alkyl dimethyl benzylammonium chloride (50% C14, 40% C12 and 10% C16 alkyl), 10% water and 10% ethanol. Further useful quaternary germicidal agents include BTC-8358®, an alkyl benzyl dimethyl ammonium chloride (80% active) and BTC-818®, a dialkyl dimethyl ammonium chloride (both presently commercially available from the Stepan Chemical Co., Chicago, Ill.). Additional suitable commercially available quaternary ammonium germicides of the alkyl dimethyl benzylammonium chloride type containing the same alkyl dimethyl benzylammonium chloride mixture as that of CYNCAL® and which are generally referred to as quaternium salts include BARQUAT® MB-80, which is believed to be solution of 80% by weight solution of the quaternary, 10% wt. ethanol and 10% wt. water; BARQUAT® MB-50, believed to be 50% wt. an alkyl dimethyl benzylammonium compound, 40% wt. water and 10% ethanol; HYAMINE® 1622 believed to be an aqueous solution of benzethonium chloride, and HYAMINE® 3500, which is believed to be a 50% aqueous solution of the quaternary (presently commercially available from Lonza Inc., Fairlawn, N.J.).

In the liquid laundry detergent compositions according to the invention Constituent (B) comprises from 1–25 parts by weight of the active constituents of the detergent compositions, more preferably comprise from 5–20 parts by weight, and most preferably comprise from 6–12 parts by weight of the active constituents of the liquid detergent compositions.

The present inventors have surprisingly found that effective germicidal efficacy of the detergent composition when diluted to form a wash bath as indicated in more detail below wherein the weight ratios of such actives of Constituent (B):Constituent (A) is at least 1:2, or greater such as 1.5:2, 2:2, 2.5:2 and even greater proportions of Constituent (B) to Constituent (A).

Constituent (C)

The compositions according to the present invention further comprise one or more nonionic surfactants selected from surfactants based upon linear and secondary alcohols, alkylphenol ethoxylates, alkyl polyglycosides, amine oxides, and, alkanolamides. Such nonionic surfactants are known and are available in commercial preparations, certain such commercial preparations providing the surfactant compound in conjunction with an aqueous carrier.

Useful nonionic surfactants include the condensation products of a higher alcohol (e.g., an alkanol containing about 8 to 18 carbon atoms in a straight or branched chain configuration) condensed with about 5 to 30 moles of ethylene oxide, for example, lauryl or myristyl alcohol condensed with about 16 moles of ethylene oxide, tridecanol condensed with about 6 to moles of ethylene oxide, myristyl alcohol condensed with about 10 moles of ethylene oxide per mole of myristyl alcohol, the condensation product of ethylene oxide with a distillation fraction of cut of coconut fatty alcohol containing a mixture of fatty alcohols with alkyl chains varying from 10 to about 14 carbon atoms in length and wherein the condensate contains either about 6 moles of ethylene oxide per mole of total alcohol or about 9 moles of ethylene oxide per mole of alcohol and tallow alcohol ethoxylates containing 6 ethylene oxide to 11 ethylene oxide per mole of alcohol.

A preferred group of nonionic surfactants are those which are presently being marketed under the trade name, "NEODOL" (Shell Chemical, Co., Houston, Tex.) These nonionic surface active agents are believed to be ethoxylated higher aliphatic, primary alcohol containing about 9–15 carbon atoms, such as $C_9$–$C_{11}$ alkanol condensed with 8 moles of ethylene oxide (NEODOL 91-8), $C_{12-13}$ alkanol condensed with 6.5 moles ethylene oxide (NEODOL 23-6.5), $C_{12-15}$ alkanol condensed with 12 moles ethylene oxide (NEODOL 25-12), $C_{14-15}$ alkanol condensed with 13 moles ethylene oxide (NEODOL 45-13), and the like.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Such nonionic surfactants are presently commercially available under the trade name "TERGITOL" (Union Carbide Corp., Danbury, Conn.). Specific examples of such commercially available nonionic surfactants of the foregoing type are $C_{11}$–$C_{15}$ secondary alkanols condensed with either 9 ethylene oxide (TERGITOL 15-S-9) or 12 ethylene oxide (TERGITOL 15-S-12) marketed by Union Carbide Corp., (Danbury, Conn.).

Other suitable nonionic surfactants include the polyethylene oxide condensates of one mole of alkyl phenol containing from about 8 to 18 carbon atoms in a straight- or branched chain alkyl group with about 5 to 30 moles of ethylene oxide. Specific examples of alkyl phenol ethoxylates include nonyl condensed with about 9.5 moles of ethylene oxide per mole of nonyl phenol, dinonyl phenol condensed with about 12 moles of ethylene oxide per mole of phenol, dinonyl phenol condensed with about 15 moles of ethylene oxide per mole of phenol and diisoctylphenol condensed with about 15 moles of ethylene oxide per mole of phenol. Commercially available nonionic surfactants of this type include IGEPAL CO-630 (a nonyl phenol ethoxylate) marketed by ISP Corp. (Wayne, N.J.) and TRITON X100 (an isooctyl phenol ethoxylate) marketed by Union Carbide Corp. (Danbury, Conn.).

Alkylpolyglycosides may also be used as a nonionic surfactant in the present inventive compositions. Preferred alkylpolyglycosides include those according to the formula:

$$R_2O—(C_nH_{2n}O)_r—(Z)_x$$

where Z is derived from glucose, R is a hydrophobic group selected from alkyl groups, alkylphenyl groups, hydroxyalkylphenyl groups as well as mixtures thereof, wherein the alkyl groups may be straight chained or branched, which contain from about 8 to about 18 carbon atoms, n is 2 or 3, r is an integer from 0 to 10, but is preferably 0, and x is a value from about 1 to 8, preferably from about 1.5 to 5. Preferably the alkylpolyglycosides are nonionic fatty alkylpolyglucosides which contain a straight chain or branched chain $C_8$–$C_{15}$ alkyl group, and have an average of from about 1 to about 5 glucose units per fatty alkylpolyglucoside molecule. More preferably, the nonionic fatty alkylpolyglucosides which contain straight chain or branched $C_8$–$C_{15}$ alkyl group, and have an average of from about 1 to about 2 glucose units per fatty alkylpolyglucoside molecule.

Exemplary alkylpolyglycosides which are presently commercially available include those presently commercially available under the tradename GLUCOPON (Henkel Corp., Ambler, Pa.)

Also useful in the nonionic surfactant constituent of the invention are nonionic surfactant compositions based on amine oxides.

One general class of useful amine oxides include alkyl di (lower alkyl) amine oxides in which the alkyl group has about 10–20, and preferably 12–16 carbon atoms, and can be straight or branched chain, saturated or unsaturated. The lower alkyl groups include between 1 and 7 carbon atoms. Examples include lauryl, dimethyl amine oxide, myristyl dimethyl amine oxide, and those in which the alkyl group is a mixture of different amine oxide, dimethyl cocoamine oxide, dimethyl (hydrogenated tallow) amine oxide, and myristyl/palmityl dimethyl amine oxide.

A further class of useful amine oxides include alkyl di (hydroxy lower alkyl) amine oxides in which the alkyl group has about 10–20, and preferably 12–16 carbon atoms, and can be straight or branched chain, saturated or unsaturated. Examples are bis(2-hydroxyethyl) cocoamine oxide, bis(2-hydroxyethyl) tallow amine oxide, and bis(2-hydroxyethyl) stearylamine oxide.

Further useful amine oxides include those which may be characterized as alkylamidopropyl di(lower alkyl) amine oxides in which the alkyl group has about 10–20, and preferably 12–16 carbon atoms, and can be straight or branched chain, saturated or unsaturated. Examples are cocoamidopropyl dimethyl amine oxide and tallowamidopropyl dimethyl amine oxide; and Additional useful amine oxides include those which may be referred to as alkylmorpholine oxides in which the alkyl group has about 10–20, and preferably 12–16 carbon atoms, and can be straight or branched chain, saturated or unsaturated.

Further examples of such useful include nonionic surfactant compositions based on amine oxides include those which are presently commercially available and include those under the trade name AMMONYX (Stepan Co., Chicago, Ill.).

In the concentrated liquid detergent compositions according to the invention Constituent (C) comprises from 3–50 parts by weight of the actives constituent in the detergent compositions taught herein. More preferably, the nonionic surfactant composition comprise from 5–30 parts by weight, and most preferably comprise from 10–25 parts by weight of the actives constituent of the present inventive liquid detergent compositions.

Further examples of these anionic, cationic and nonionic surfactant compositions recited above may be found in *McCutcheon's Detergents and Emulsifiers*, Vol. 1, and/or; Kirk-Othmer, *Encyclopedia of Chemical Technology*, noted above.

Constituent (D)

While not always included in compositions according to the present invention, the present inventors have found that a minor amount of a further anionic co-surfactant provides further detersive action and foaming action. Such a further anionic surfactant is present in a relatively small amount, i.e., less than 10 parts by weight based on the total weight of the liquid detergent composition, with the further limitation that such anionic co-surfactant is present in an amount of no more than ½ of the total weight of Constituent (B).

Anionic surfactants which are useful for use as the recited anionic co-surfactant which may be any anionic surfactant which is determined not to undesirably detract from the efficacy of Constituent (B) when included in a formulation within the scope of the instant invention. Known anionic surfactants may be used, including for example, alkali metal salts or ammonium salts of compounds selected from certain alkylsulfates, alkylsulfonates, alkylethersulfates, alkylarylsulfonates, alkylarylethersulfates, and mixtures thereof.

A further class of useful anionic surfactants which find use as the co-surfactant recited herein include alkyl ethersulfates and salts thereof, especially one or more alkyl ethersulfates which may be represented by the following general formula:

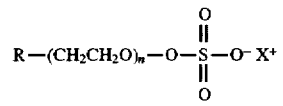

wherein R is a $C_8$–$C_{18}$ alkyl group, n is an integer from 1 to 30, and X represents an counterion selected from alkaline earth metals and ammonium. Of these alkyl ethersulfates, especially preferred are those wherein R is a $C_{12}$–$C_{15}$ group, n is 4, and X is a sodium cation or is an ammonium cation, i.e., $NH_4^+$. Such alkyl ether sulfates may be produced by known methods, or in the alternative are presently commercially available under the trade name "STEOL" (Stepan Chem. Co., Chicago, Ill.).

Such anionic surfactants are known and are available in commercial preparations wherein they are frequently provided in conjunction with an aqueous carrier. Further useful anionic surfactants useful as the co-surfactant include those illustrated in the Examples, below. Of course, it is to be understood that one or more anionic surfactants may be used to provide the anionic co-surfactants according to Constituent (D).

As indicated above, when present, the anionic co-surfactant according to Constituent (D) comprises from 0–10 parts by weight of the liquid detergent compositions of the present invention. More preferably the anionic co-surfactant comprises from 1–8 parts by weight, and most preferably comprise from 2–5 parts by weight of the liquid detergent compositions, with the proviso that the weight ratios of the cationic surfactant composition of Constituent (B): the anionic co-surfactant composition of Constituent (D) is at least 2:1, but are preferably greater, and most preferably in a ratio of at least 2.5:1.

Optionally, the compositions include up to 10% by weight of conventional laundry detergent additives as known in the art including but not limited to: builders and chelating agents, pH adjusters, stabilizers, rheology modifying agents, sequestrants, optical brighteners, solvents including alcohols such as ethanol and propylene glycol, hydrotropes such as sodium and potassium aryl sulfones and alkarylsulfonates, coloring agents, and fragrances. Many of these are known to the art, and include those which are described in *McCutcheon's Functional Materials*, Vol.2, North American Edition, (1991), and each may be included at effective concentrations, with the total of such optional constituents preferably not exceeding 10% by weight of the total liquid laundry detergent composition taught herein.

For the stabilization of the inventive composition the use of pH stabilizing agents, interchangeably referred to as pH buffers, the inclusion of any pH buffering compound or pH buffer composition which is compatible with the aqueous compositions taught herein may be used, including many which are well known to the art. Examples of such useful pH buffer compounds and/or pH buffering systems or compositions include the alkali metal phosphates, polyphosphates, pyrophosphates, triphosphates, tetraphosphates, silicates, metasilicates, polysilicates, carbonates, hydroxides, and mixtures of the same. Certain salts, such as the alkaline earth phosphates, carbonates, hydroxides, can also function as buffers. It may also be suitable to use buffers such materials as aluminosilicates (zeolites), borates, aluminates and certain organic materials such as gluconates, succinates, maleates, and their alkali metal salts. Such buffers keep the pH ranges of the compositions of the present invention within acceptable limits. Other pH buffers, not particularly elucidated here may also be used. Preferably, citric acid, which is available as an anhydrous salt of an alkali metal citric acid, is added as it is readily commercially available, and effective. Citric acid is preferred as it is effective and is widely available at a low cost.

As noted above, the compositions of the invention when diluted to form a 0.20% solution in water which is equivalent to a dilution of 1 part of the inventive composition to 500 parts water, preferably deionized water, exhibit a pH in the range of 5–10, more preferably a pH in the range 7–8, and most preferably a pH of about 8. The incorporation of an effective amount of such a pH stabilizing agent provides the technical benefits of ensuring the stability of the compositions of the invention as formulated, and as used when added to an excess of water to form a cleaning composition therefrom. As is known to those skilled in the relevant art, various stains and food deposits may impart an appreciable change in the pH of water from an approximately neutral pH to that of an acidic or basic pH. The inclusion of an effective amount of a pH stabilizing agent in the compositions, when added to the excess of water will tend to return the pH of a cleaning composition to a more neutral pH. While it will be realized that the selection of the other constituents forming the inventive compositions may necessitate varying amounts of a pH buffer composition, the buffer composition generally is included in effective amounts which are conventionally determinable in order to adjust the pH of the diluted compositions to the indicated pH ranges, particularly to the preferred pH ranges indicated above.

A further optional constituent which may be desirably included in the inventive compositions include a detergency builder component. Detergency builders, of the organic or inorganic type may be desirably included in the present inventive compositions. Exemplary builders include water soluble inorganic builders which can be used alone, in admixture with other water soluble inorganic builders, as well as in conjunction with one or more organic alkaline sequestrant builder salt. When present, the detergency builder component generally is included to comprise up to 6 parts by weight, but preferably only up to 5 parts by weight of the composition.

Exemplary detergency builders include alkali metal carbonates, phosphates, polyphosphates and silicates. More specific examples include sodium tripolyphosphate, sodium carbonate, potassium carbonate, sodium polyphosphate, potassium pyrophosphate, potassium tripolyphosphate, and sodium hexametaphosphate.

Exemplary organic alkaline sequestrant builder salts include alkali metal polycarboxylates including water-soluble citrates such as calcium, sodium and potassium citrate, calcium, sodium and potassium tartarate, calcium, sodium and potassium ethylenediaminetetraacetate, calcium, sodium and potassium N-(2-hydroxyethyl)ethylene diamine triacetates, calcium, sodium and potassium nitrilo triacetates, as well as calcium, sodium and potassium tartrate or mono- and di-succinates. As noted, these organic builder salts may be used individually, as a combination of two or more organic builder salts, as well as in conjunction with one or more detergency builders, including those indicated above. Of these, especially preferred are ethylenediaminetetraacetic acid, and salts thereof particularly calcium and sodium salts thereof, and HEDTA and salts thereof. Other known art chelating agents may be used, including sodium gluconate, gluconic acid and salts thereof and sorbitol may also be used.

Further optional, but frequently desirable constituents include fragrances, which may be derived from natural sources or which may be synthetically produced. Such fragrances are known to the art, and may be added in any conventional manner, such as by admixing to a concentrate composition or blending with other constituents used to form a concentrate composition, in amounts which are found to be useful to enhance or impart the desired scent characteristic to the concentrate composition, and/or to cleaning compositions formed therefrom.

Further optional, but advantageously included constituents are one or more coloring agents which find use in modifying the appearance of the concentrate compositions and enhance their appearance from the perspective of a consumer or other end user. Known coloring agents, may be incorporated in the compositions in any effective amount to improve or impart to concentrate compositions a desired appearance or color. Such a coloring agent or coloring agents may be added in a conventional fashion, i.e., admixing to a concentrate composition or blending with other constituents used to form a concentrate composition.

Water forms a constituent of the concentrated liquid detergent compositions and the water may be tap water, but is preferably distilled and/or deionized water. If the water is tap water, it is preferably appropriately filtered in order to remove any undesirable impurities such as organics or inorganics, especially mineral salts which are present in hard water which may thus interfere with the operation of the invention. The amount of water added is an amount to provide the balance of the composition to provide 100 parts by weight. Generally, the water is added, generally in an amount of 40 to 95 parts by weight, so to provide the balance of the total inventive composition. It is to be recognized that one or more of the constituents according to the invention may be commercially available as aqueous mixtures comprising one or more actives constituents, in which case their aqueous portion is to be considered separately from the actives portion, as has been noted above. Also, as has been previously noted, up to 10 parts by weight of the total liquid laundry detergent composition may be comprised of the one or more optional conventional laundry detergent additives and accordingly, the total amount of water may be proportionately reduced to allow the addition of such further optional additives.

The compositions according to the present invention are particularly useful as an aqueous liquid detergent in concentrated form. The critical components of the composition are the predominant anionic surfactants according to Constituent (A), viz., the alkylethercarboxylate, and/or alkylethersulfonate and Constituent (C), viz., the one or more quaternary ammonium surfactants. We have surprisingly discovered that the critically selected anionic surfactants are compatible with quaternary ammonium germicides in the recited proportions, and thereby up to very high ratios of anionic surfactant: cationic quaternary ammonium surfactant are now obtainable in accordance with the present inventive teaching, as compared with prior art teachings relating to the compatibility between anionic and cationic surfactants. By compatibility, it is meant that these critically selected anionic surfactants do not impair the antimicrobial activity of the quaternary component to any significant degree. This is in sharp contrast to other anionic surfactants, which significantly impair the antibacterial activity of quaternaries, as has been recited in the prior art and exemplified below. The surprising discovery described in the instant invention allows the formulation of unique and useful detergent compositions which simultaneously provides excellent cleaning combined with uncompromised antibacterial protection, even in formulations with high levels of anionic surfactant.

The compositions according to the invention are prepared by dissolving the individual constituents in order to provide a liquid concentrate. In use, the concentrate is added to the wash water in an amount effective to achieve either cleaning and brightening as well as sanitization of the fabrics or garments being washed. It has been found that from approximately ½ to about ¾ cup of the liquid laundry detergent concentrate compositions per wash load (domestic washing machine) is generally adequate to achieve good cleaning and sanitization of such a domestic wash load. Thus, based on the total wash water volume of approximately 16 gallons of water, the compositions can be used at dilutions of the concentrated composition:water from about 1:500 to 1:330, although even lower dilutions may be also used and provide such excellent cleaning and sanitization effects. Conventional washing machines may be used utilizing conventional washing cycles, particularly wherein the wash water is at a temperature in the range of 20° C.–40° C. degrees, and for a bath contact time of 10–20 minutes.

EXAMPLES

Preparation of Example Formulations

Several laundry detergent formulations according to the invention were prepared, as well as comparative examples, all of which are described in detail on Table 1, below. Examples 1 through 6 illustrate formulations which are in accordance with the present inventive teaching and exhibit ratios of the quaternary ammonium surfactant constituent (constituent B) having germicidal properties to the anionic alkylethercarboxylate and/or alkylethersulfonate surfactant constituent (constituent A) of 1:2 or greater as is disclosed in the specification above. The comparative examples, C1 through C4 describe compositions having similar constituents, which however fall outside of the ratio between constituents B:A of at least 1:2 as described above. It is to be noted that these ratios are calculated on the actives portion, or "actives" of an in individual constituent more than one of which is supplied as an aqueous composition itself, and not necessarily upon the weight percentage of a particular constituent as indicated on Table 1 below. The percentage of actives of each of the particular constituents indicated on Table 1, as well as their identity, is succinctly provided in Table 2, below.

These formulations were prepared by adding a measured amount of deionized water to a suitable glass beaker, and utilizing a magnetic stirrer, stirring the water during the addition of the further measured amounts of the remaining constituents to the water. In certain of the formulations, an amount of sodium hydroxide was added in sufficient amounts to neutralize the NEODOX 25-6, which was provided in its acid form. Afterwards, the formulations were stirred for a further 15 to 30 minutes using a magnetic stirring bar, and in each case the formulations resulted in a homogeneous liquid, suitable for use as a laundry detergent at a dilution of about 1:500 in a household washing machine.

TABLE 1

| | Ex.1 | Ex.2 | Ex.3 | Ex.4 | Ex.5 | Ex.6 | Ex.7 | Ex.8 | C1 | C2 | C3 | C4 |
|---|---|---|---|---|---|---|---|---|---|---|---|---|
| SURFINE WLG | — | — | — | — | 5.09 | 20.19 | — | — | — | 25.06 | 150.09 | — |
| NEODOX 25-6 | — | 14.99 | 10.2 | — | — | — | 3.97 | 10.41 | — | — | — | 45.07 |
| AVANEL S30 | 14.96 | — | — | 10.01 | — | — | — | — | — | — | — | — |
| AVANEL S70 | — | — | — | — | — | — | — | — | 49.97 | — | — | — |
| BIOSOFT D40 | 5.01 | — | — | — | — | 1.75 | — | — | — | — | — | — |
| STEOL CS-460 | — | — | — | 3.5 | 4.04 | — | — | — | 5.12 | — | — | 5.05 |
| NEODOL 25-7 | — | 10.2 | 15 | 4.8 | — | — | 7.3 | 8.0 | — | 11.19 | 67.21 | — |
| TERGITOL NP-9 | — | — | — | — | 17.15 | — | — | — | 10.1 | — | — | 5.32 |
| AMMONYX LO | — | — | — | 5.13 | — | 10.1 | — | — | — | — | — | — |
| APG 325 | 10.75 | — | — | 3.05 | 4.89 | — | — | — | — | — | — | — |
| BARQUAT MB50 | — | 30.3 | 12.8 | — | — | 12.87 | 12.8 | 12.8 | — | 12.8 | 77.12 | 24.93 |
| BARDAC 2250 | 12.84 | — | — | 10.09 | 11.07 | — | — | — | 11.1 | — | — | — |
| STEPANATE SXS | 5.21 | — | 3.14 | — | — | 3.02 | — | — | 3.09 | 3 | 18.04 | 3.05 |
| TINOPAL CBS-X | — | — | — | 0.14 | — | — | — | — | 0.9 | 0.14 | — | — |
| BLANKOPHOR TX | 3.13 | 2 | 3.1 | — | 2 | — | — | 3.0 | — | — | 15.01 | — |
| sodium citrate | 4.13 | — | 5.37 | — | — | 5.11 | — | — | — | 5.6 | 33.61 | 3.08 |
| NaOH | — | yes | yes | — | — | — | 0.52 | 1.36 | — | — | — | yes |
| deionized water | 44.03 | 42.81 | 51.17 | 68.23 | 59.67 | 47.02 | 75.41 | 64.43 | 20.72 | 45.28 | 236.81 | 14.2 |
| ratio of B:A | 1.4:1.0 | 1.0:0.9 | 1.0:1.5 | 1.6:1.0 | 1.8:1.0 | 1.0:1.9 | 1.8:1.0 | 1.0:1.4 | 1.0:3.2 | 1.0:2.3 | 1.0:2.3 | 1.0:3.4 |
| ratio of B:D | 3.2:1.0 | — | — | 2.4:1.0 | 2.28:1.0 | 9.0:1.0 | — | — | 1.8:1.0 | — | — | 4.0:1.0 |

TABLE 2

| Constituent: | Tradename: | Description: |
|---|---|---|
| A | SURFINE WLG | sodium salt of $C_{12-15}$—$EO_7$—$CH_2COO^-$ [60% wt. actives (AEC-salt form)] |
| A | NEODOX 25-6 | $C_{12-15}$—$EO_6$—$CH_2COOH$ [88.5% wt. actives (AEC-acid form)] |
| A | AVANEL S30 | sodium salt of $C_{12-15}$—$EO_3$—$CH_2CH_2SO_3^-$ [30% wt. actives] |
| A | AVANEL S70 | sodium salt of $C_{12-15}$—$EO_7$—$CH_2CH_2SO_3^-$ [35% wt. actives] |
| D | BIOSOFT D40 | sodium salt of linear alkylbenzene sulfonate [40% wt. actives] |
| D | STEOL CSA60 | sodium lauryl-3-ethoxy sulfate [60% wt. actives] |
| C | NEODOL 25-7 | $C_{12-15}$—$EO_7$ [100% wt. actives] |
| C | TERGITOL NP-9 | nonylphenol-$EO_9$ [100% wt. actives] |
| C | AMMONYX LO | dodecyldimethyl amine oxide [30% wt. actives] |
| C | APG 325 CS | $C_{9-11}$ alkylpolyglycoside [50% wt. actives] |
| B | BARQUAT MB50 | alkyldimethylbenzyl ammonium chloride [50% wt. actives] |
| B | BARQUAT 2250 | dialkyldimethyl ammonium chloride [50% wt. actives] |
| — | sodium citrate | trisodium salt of citric acid - dihydrate [100% wt. actives] |
| — | NaOH | sodium hydroxide, aqueous [50% wt.actives] |
| — | STEPANATE SXS | sodium xylene sulfonate [40% wt. actives] |
| — | TINOPAL CBS-X | proprietary optical brightener |
| — | BLANKOPHOR TX | proprietary optical brightener |

"EO" respresents ethoxy
"AEC" represents alkyl ether carboxylate

Evaluation of Antimicrobial Efficacy

Experimental formulations Ex.1, C1, Ex.3, C4, Ex.4 and Ex.5 were evaluated for antimicrobial efficacy at a dilution of 1:500 using a Microbial Reduction Assay against *Salmonella choleraesuis* (gram negative type pathogenic bacteria) and *Staphylococcus aureus* (gram positive type pathogenic bacteria).

The test was carried out for each of the Ex. 1, C1, Ex.3, C4, Ex.4 and Ex.5 formulations at dilution of one part of a respective formulation to 499 parts of deionized water at 25° C. for a 10 minute contact time. The test protocol followed for each sample was generally as follows.

1. Inoculation of the Samples:

A. Inoculate 1.0 ml of the 24 hour test culture into each 9.0 ml sample tube; and test in duplicate.

B. Subculture 1.0 ml of the sample after 10 minutes contact time with the respective diluted Example formulation.

C. Subculture the sample into 9.0 ml of DIFCO AOAC Letheen Broth to form a "$10^{-1}$, Sample" dilution.

2. Sample Dilutions and Plating

A. Plate the $10^{-1}$, $10^{-3}$, and $10^{-5}$ dilutions for each sample/organism/contact time combination by the following general protocol:

1. From the $10^{-1}$ "Sample" dilution, plate 1.0 ml to form a $10^{-1}$ "Sample" plate.
2. Pipette and transfer 0.1 ml of the $10^{-1}$ Sample dilution into 9.9 ml of DIFCO AOAC Letheen Broth to form a "$10^{-3}$ Sample" dilution and form a $10^{-3}$ plate.

3. Pipette and transfer 0.1 ml of $10^{-3}$ Sample dilution to 9.9 ml DIFCO AOAC Letheen Broth to form a "$10^{-5}$ Sample" dilution and form a $10^{-5}$ plate.

B. Pour each of the $10^{-1}$ plates, $10^{-3}$ plate, and $10^{-5}$ plate with Tryptic Soy Agar containing polysorbate 80 and lecithin (either DIFCO or BBL).

C. Incubate the plates for 48 hours at 35° C.

3. Control Counts: Dilutions and Plating

A. Inoculate 1.0 ml of 24 hour test culture into 9.0 ml DIFCO AOAC Letheen Broth to form a "Control" dilution.

B. Subculture 1.0 ml of the Control dilution into 9.0 ml DIFCO AOAC Letheen Broth at 10 minutes exposure; these are the "$10^{-1}$ Control" dilution tubes for the 10 minutes contact time controls.

C. Plate $10^{-4}$ and $10^{-5}$ dilutions of the $10^{-1}$ Control dilution for each contact time by the following protocol:

1. Pipette 0.1 ml of the $10^{-1}$ Control dilution into 9.9 ml DIFCO AOAC Letheen Broth to form a "$10^{-3}$ Control" dilution.
2. Plate 1.0 ml of the $10^{-3}$ Control dilution into 9.0 ml DIFCO AOAC Letheen Broth to form a "$10^{-4}$ Control" dilution and form a "$10^{-4}$ Control" plate.
3. Pipette 0.1 ml of the $10^{-3}$ Control dilution into 9.9 ml of ml DIFCO AOAC Letheen Broth to form a "$10^{-5}$ Control" dilution, and to form a "$10^{-5}$ Control" plate.
4. Pour the $10^{-4}$ and $10^{-5}$ Control plates with Tryptic Soy Agar containing polysorbate 80 and lecithin, and incubate at 35° C. for 48 hr.

4. Calculation of $Log_{10}$ Reduction

A. Determine the number of bacteria survivors at each contact time for both the controls and test samples of each of the plates produced in accordance with the protocols outlined for steps 1–3 denoted above.

1. Count the number of colonies on the petri dish. The plate is acceptable for counting with a colony count between 25 and 250.
2. Multiply the number of colonies by the plate dilution factor=the number of surviving bacteria/ml.

B. Determine the numbers of $Log_{10}$ reduction in bacteria for each sample/organism/contact time combination in accordance with the following equation:

$$Log_{10}\text{ (Control Count)}-Log_{10}\text{ (Survivor Count)}=\#\ Log_{10}\text{ of bacteria reduction.}$$

For this test with a contact time of 10 minutes, a $Log_{10}$ reduction value of 3 or greater against both organisms is acceptable for "passing" performance (i.e., broad spectrum antimicrobial activity), any lesser $Log_{10}$ reduction value indicates unacceptably poor antimicrobial efficacy. The results of this evaluation are summarized on Table 3, below.

TABLE 3

| | $Log_{10}$ Reduction of *Salmonella choleraesuis* | $Log_{10}$ Reduction of *Staphylococcus aureus* |
|---|---|---|
| Ex. 1 | 4.6 | 5.6 |
| C 1 | 0 | 1.1 |
| Ex. 3 | 4.9 | 4.6 |
| C 4 | 0 | 1 |
| Ex. 5 | 4.9 | 5.6 |
| Ex. 6 | 4.9 | 5.6 |

The results reported on Table 3 clearly and distinctly point out the advantages of the formulations according to the applicant's inventive composition inside the preferred ranges of the critical component ratios, as opposed to those which fall outside the critical component ratios. As may be seen, those formulations according to the invention surprisingly and unexpectedly provide superior levels of antimicrobial activity as evidenced by the reported $Log_{10}$ reduction values>3 as noted on Table 3. This is in sharp contrast to the comparative formulations which included ratios of constituents B:A which were outside of the applicant's preferred ranges for these constituents as discussed in more the specification above.

The results of Table 3 also illustrate the excellent germicidal efficacy of the present inventive compositions over known prior art compositions such as those described in U.S. Pat. No. 4,576,529 in its Table 2 wherein germicidal efficacy was found at a maximum dilution of 1 part of composition to 333 parts water, but where most of the prior art compositions were found effective in dilutions of 1 part of composition to 200–250 parts water, which are dilutions far below typical dilutions used for laundry products and which could thus be disadvantageous to use from both a cost standpoint, and from a consumer acceptance standpoint. These results are in contrast to the present inventive compositions which provide excellent germicidal efficacy at typical laundry product composition dilutions, i.e., 1:500 as is demonstrated by the results on Table 3 above and thus would be expected to overcome many of the technical and consumer prejudices which might be associated with prior art compositions.

In-use Laundry Sanitization

An "in-use" laundry sanitization test was performed under conditions which simulated a domestic, viz., "in-home" laundering process, in accordance with a simulated in-use test recommended by the U.S. Environmental Protection Agency (EPA) and in the EPA Product Performance Guidelines, which is a well known test method for antimicrobial laundry additives published by Petrocci and Clarke in the Journal of the Assoc. of Official Analytical Chemists, volume 52, pages 836–842 (1969), the contents of which are herein incorporated by reference. These evaluations were performed utilizing a formulation according to Example 7, which is disclosed in detail on Table 1. In summary, inoculated fabric swatches are contacted with a test detergent dilution for 10 minutes followed by neutralization and performance of plate counts for the enumeration of survivors and calculation of the percent reduction. The percent reduction in the bacteria is calculated for the swatches and wash water separately.

In this evaluation, the formulation according to Example 7 was tested for laundry saritization against the test organism *Klebsiella pneumoniae*, a common gram negative pathogen, at a use dilution of 1:365. For comparative purposes, a sample of ULTRA LIQUID TIDE, (a presently commercially available product of the Procter and Gamble Co., Cincinnati Ohio) was tested at its recommended use dilution of 1:640. For control purposes, a sample of LYSOL Brand Disinfectant Fresh Scent (a product of Reckitt & Colman Inc., registered with the EPA for use as a laundry sanitizer at a dilution of 1:250) was tested at a use dilution of 1:250. The results of these tests are summarized in Table 4, where as with the results of Table 3, the higher percent reduction reported indicates greater antimicrobial efficacy.

TABLE 4

| | % reduction in 10 minutes of *Klebsiella pneumoniae* | |
|---|---|---|
| | fabric swatch | wash water |
| Example 7 | 99.99 | 100 |
| Ultra Liquid Tide | 51.1 | 21.8 |
| Lysol Brand Disinfectant | 99.999 | 100 |

The results in Table 4 clearly demonstrate the superior efficacy of the compositions according to Ex.7 over the currently commercially available detergent product with respect to laundry sanitization activity.

In-use Laundry Detergency

This example demonstrates the utility of a composition of the instant invention for use as a laundry detergent. The formulation according to Example 8 was evaluated for laundry detergency. Cotton and 50/50 polyester/cotton blend fabric sample swatches were purchased from Test Fabrics (Middlesex, N.J.) and Scientific Services (Oakland, N.J.) The fabrics were soiled with either a standardized particulate soil, "KREFELD soil", a dust/sebum soil, an oily particulate soil, or grape juice, a stain. The soiled test fabrics were washed in a domestic washing machine using ½ cup of the liquid composition according to Ex. 8 to produce a 1:500 dilution in the wash bath (Sears KENMORE Model Ultra Fabric Care Heavy Duty Washing Machine (80 Series)) on a "normal" wash cycle and a "high" water setting. During this "normal" wash cycle, a warm water (105° F.) wash cycle was of 10 minutes duration, followed by cold water rinse cycle. Water hardness was 150 ppm. Solids removal, viz., stain removal from the various soils was assessed quantitatively using a Hunter Lab calorimeter, which measured each of the following values: the lightness ("$L_c$") of the unstained swatch; the lightness of the stained and subsequently washed swatch ("$L_w$"); redness-greenness of the unstained swatch ("$a_c$"), redness-greenness of the stained and subsequently washed swatch ("$a_w$"), yellowness-blueness of the unstained ("$b_c$") swatch, and yellowness-blueness of the stained and subsequently washed swatch ("$b_w$"); each of these values measured as the amount of the standardized white light reflected from the fabrics. The quantitatively evaluated values were measured for the various tested fabric swatches and were used to calculate the Stain Removal Index (SRI) according to the equation:

$$SRI=100-[(L_c-L_w)^2+(a_c-a_w)^2+(b_c b_w)^2]^{1/2}$$

and the results are reported on Table 5, below. The SRI value ranges from 0 to 100, with a value of 100 indicating complete soil removal.

TABLE 5

| | SRI values | |
|---|---|---|
| Stain | Cotton | Polyester/Cotton |
| KREFELD soil | 80.41 | 80.93 |
| dust/sebum | 82.53 | 80.34 |
| grape juice | 81.59 | 85.19 |

As can be seen from the results reported on Table 5, the reported SRI values indicate excellent detergency of the formulation according to Example 8, a representative formulation according to the instant invention, under domestic laundry conditions, even at a relatively dilute ratios of 1:500 of formulation:wash bath water.

While described in terms of the presently preferred embodiments, it is to be understood that the present disclosure is to be interpreted as by way of illustration, and not by way of limitation, and that various modifications and alterations apparent to one skilled in the art may be made without departing from the scope and spirit of the present invention.

I claim:

1. An aqueous liquid laundry detergent composition having germicidal efficacy comprising:

A) 1–40 parts by weight of one or more anionic surfactant compositions selected from alkylethercarboxylates and alkylethersulfonates;

B) 1–25 parts by weight of one or more quaternary ammonium surfactant compositions having germicidal properties;

C) 3–50 parts by weight of one or more nonionic surfactant compositions selected from linear and secondary alcohol alkoxylates, alkylphenol ethoxylates, alkyl polyglycosides, amine oxides, alkanolamides;

D) 0–10 parts by weight of one or more anionic co-surfactant compositions selected from alkylsulfates, alkylsulfonates, alkylethersulfates, alkylarylsulfonates, alkylarylethersulfates present in a proportion not exceeding one half of the weight of the one or more quaternary ammonium surfactant compositions having germicidal properties;

wherein the weight ratios of B:A are at 1:2 to 2.5:2 with the remaining balance to 100 parts by weight of water.

2. The aqueous liquid laundry detergent composition according to claim 1 wherein the one or more anionic surfactant compositions is an alkylethercarboxylate or salt thereof according to the formula:

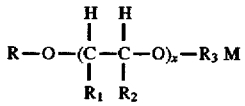

where:

R is a $C_{4-22}$ linear or branched alkyl group, x is an integer from 1 to 24, $R_1$, $R_2$ and $R_3$ is a group selected from H, lower alkyl radicals including methyl radicals and ethyl radicals, carboxylate radicals including acetate and propionate radicals, succinate radicals, hydroxysuccinate radicals, or mixtures thereof wherein at least one $R_1$, $R_2$ or $R_3$ is a carboxylate, succinate or hydroxysuccinate radical; and, $M^+$ is alkali metal or ammonium counterion.

3. The aqueous liquid laundry detergent composition according to claim 2 wherein:

R is a $C_{12-15}$ linear or branched alkyl group, x is an integer from 1 to 10, $R_1$, $R_2$ and $R_3$ is a group selected from H, carboxylate radicals, or mixtures thereof wherein at least one $R_1$, $R_2$ or $R_3$ is a carboxylate radical; and, $M^+$ is sodium, potassium or ammonium counterion.

4. The liquid laundry detergent composition according to claim 3 wherein:

R is a $C_{12-15}$ linear or branched alkyl group;

x is an integer from 1 to 10;

$R_1$ and $R_2$ are hydrogen;

$R_3$ is a carboxylate radical; and, $M^+$ is sodium, potassium or ammonium counterion.

5. The liquid laundry detergent composition according to claim 1 wherein the one or more anionic surfactant compositions is an alkylethersulfonate or salt thereof according to the formula:

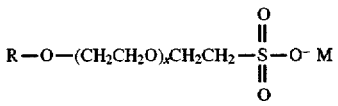

where:

R is a $C_{4-22}$ linear or branched alkyl group, x is an integer from 1 to 24, and, $M^+$ is alkali metal or ammonium counterion.

6. The liquid laundry detergent composition according to claim 5 wherein:

R is a $C_{12-15}$ linear or branched alkyl group, x is an integer from 1 to 10, and, $M^+$ is a sodium, potassium or ammonium counterion.

7. The liquid laundry detergent composition according to claim 1 wherein one or more quaternary ammonium surfactant compositions having germicidal properties is one or more quaternary ammonium compounds and salts thereof according to the formula:

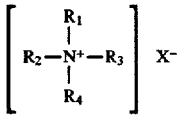

where:

at least one of $R_1$, $R_2$, $R_3$ and $R_4$ is a hydrophobic, aliphatic, aryl aliphatic or aliphatic aryl radical of from 6 to 26 carbon atoms; and, the entire cation portion of the molecule has a molecular weight of at least 165.

8. The liquid laundry detergent composition according to claim 7 wherein one or more quaternary ammonium surfactant compositions having germicidal properties is one or more quaternary ammonium compounds and salts thereof according to the structural formula:

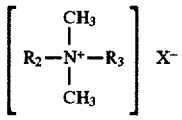

wherein:

$R_2$ and $R_3$ are selected from straight chained or branched $C_8$–$C_{12}$alkyl radicals, or $R_2$ is selected from straight chained or branched $C_{12-16}$alkyl, $C_{8-18}$alkylethoxy, $C_{8-18}$alkylphenolethoxy radicals and $R_3$ is benzyl; and, X is a halide, or methosulfate.

9. The liquid laundry detergent composition according to claim 1 wherein the anionic co-surfactant is an alkylether sulfate or salt thereof according to the formula:

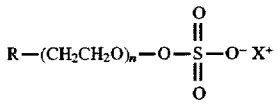

where:

R is a $C_8$–$C_{18}$alkyl group;

n is an integer from 1 to 30; and,

X represents an counterion selected from alkaline earth metals and ammonium.

10. Aqueous liquid laundry detergent compositions having germicidal efficacy according to claim 1 further comprising:

0 to 10 parts by weight based on the total weight of the aqueous detergent composition of one or more additives selected from: builders, chelating agents, pH adjusters, stabilizers, hydrotropes, rheology modifying agents, sequestrants, optical brighteners, solvents, coloring agents, and fragrances.

11. The Aqueous liquid laundry detergent compositions having germicidal efficacy according to claim 1 comprising:

A) 5–30 parts by weight of one or more anionic surfactant compositions selected from alkylethercarboxylates and alkylethersulfonates;

B) 5–20 parts by weight of one or more quaternary ammonium surfactant compositions having germicidal properties;

C) 5–30 parts by weight of one or more nonionic surfactant compositions selected from linear and secondary alcohol alkoxylates, alkylphenol ethoxylates, alkyl polyglycosides, amine oxides, alkanolamides;

D) 1–8 parts by weight of one or more anionic co-surfactant compositions selected from alkylsulfates, alkylsulfonates, alkylethersulfates, alkylarylsulfonates, alkylarylethersulfates present in a proportion not exceeding one half of the weight of the one or more quaternary ammonium surfactant compositions having germicidal properties;

wherein the weight ratios of B:A are at 1:2 or greater;

with the remaining balance to 100 parts by weight of water.

12. Aqueous liquid laundry detergent compositions having germicidal efficacy according to claim 11 wherein the weight ratios of B:A are at least 1.5:2.

13. Aqueous liquid laundry detergent compositions having germicidal efficacy according to claim 11 comprising:

A) 10–20 parts by weight of one or more anionic surfactant compositions selected from alkylethercarboxylates and alkylethersulfonates;

B) 6–12 parts by weight of one or more quaternary ammonium surfactant compositions having germicidal properties;

C) 10–25 parts by weight of one or more nonionic surfactant compositions selected from linear and secondary alcohol alkoxylates, alkylphenol ethoxylates, alkyl polyglycosides, amine oxides, alkanolamides;

D) 2–5 parts by weight of one or more anionic co-surfactant compositions selected from alkylsulfates, alkylsulfonates, alkylethersulfates, alkylarylsulfonates, alkylarylethersulfates present in a proportion not exceeding one half of the weight of the one or more quaternary ammonium surfactant compositions having germicidal properties;

wherein the weight ratios of B:A are at 1:2 or greater, with the remaining balance to 100 parts by weight of water.

14. Aqueous liquid laundry detergent compositions having germicidal efficacy according to claim 11 wherein the weight ratios of B:A are at least 1.5:2.

15. A process for the simultaneous laundering and santiziation of textile fabrics comprising the process step of:

laundering said textile fabrics in an aqueous wash bath which contains an aqueous liquid laundry detergent composition having germicidal efficacy which comprises:

A) 1–40 parts by weight of one or more anionic surfactant compositions selected from alkylethercarboxylates and alkylethersulfonates;

B) 1–25 parts by weight of one or more quaternary ammonium surfactant compositions having germicidal properties;

C) 3–50 parts by weight of one or more nonionic surfactant compositions selected from linear and secondary alcohol alkoxylates, alkylphenol ethoxylates, alkyl polyglycosides, amine oxides, alkanolamides;

D) 0–10 parts by weight of one or more anionic co-surfactant compositions selected from alkylsulfates, alkylsulfonates, alkylethersulfates, alkylarylsulfonates, alkylarylethersulfates present in a proportion not exceeding one half of the weight of the one or more quaternary ammonium surfactant compositions having germicidal properties;

wherein the weight ratios of B:A are at 1:2 to 2.5:2, with the remaining balance to 100 parts by weight of water.

16. The process according to claim 15 wherein the liquid laundry detergent compositions are present in the aqueous bath in a weight ratio of detergent composition:water of at least 1:500.

17. The process according to claim 16 wherein the liquid laundry detergent compositions are present in the aqueous bath in a weight ratio of detergent composition:water of from 1:500–1:330.

18. A process according to claim 15 for the simultaneous laundering and santiziation of textile fabrics comprising the process step of:

laundering said textile fabrics in an aqueous wash bath which contains an aqueous liquid laundry detergent composition having germicidal efficacy which comprises:

A) 5–30 parts by weight of one or more anionic surfactant compositions selected from alkylethercarboxylates and alkylethersulfonates;

B) 5–20 parts by weight of one or more quaternary ammonium surfactant compositions having germicidal properties;

C) 5–30 parts by weight of one or more nonionic surfactant compositions selected from linear and secondary alcohol alkoxylates, alkylphenol ethoxylates, alkyl polyglycosides, amine oxides, alkanolamides;

D) 1–8 parts by weight of one or more anionic co-surfactant compositions selected from alkylsulfates, alkylsulfonates, alkylethersulfates, alkylarylsulfonates, alkylarylethersulfates present in a proportion not exceeding one half of the weight of the one or more quaternary ammonium surfactant compositions having germicidal properties;

wherein the weight ratios of B:A are at 1:2 or greater, with the remaining balance to 100 parts by weight of water.

19. The process according to claim 18 wherein the liquid laundry detergent compositions are present in the aqueous bath in a weight ratio of detergent composition:water of from 1:500–1:330.

20. An aqueous liquid laundry detergent composition according to claim 1 which comprises:

A) 1–40 parts by weight of an alkylethersulfonate;

B) 1–25 parts by weight of one or more quaternary ammonium surfactant compositions having germicidal properties;

C) 3–50 parts by weight of one or more nonionic surfactant compositions selected from linear and secondary alcohol alkoxylates, alkylphenol ethoxylates, alkyl polyglycosides, amine oxides, alkanolamides;

D) 0–10 parts by weight of one or more anionic co-surfactant compositions selected from alkylsulfates, alkylsulfonates, alkylethersulfates, alkylarylsulfonates, alkylarylethersulfates present in a proportion not exceeding one half of the weight of the one or more quaternary ammonium surfactant compositions having germicidal properties;

wherein the weight ratios of B:A are at 1:2 or greater, with the remaining balance to 100 parts by weight of water.

* * * * *